US007999757B2

(12) United States Patent
Du

(10) Patent No.: US 7,999,757 B2
(45) Date of Patent: Aug. 16, 2011

(54) MULTI-BAND CEILING ANTENNA

(75) Inventor: Xin Du, Schaumburg, IL (US)

(73) Assignee: PCTEL, Inc., Bloomingdale, IL (US)

( * ) Notice: Subject to any disclaimer, the term of this patent is extended or adjusted under 35 U.S.C. 154(b) by 632 days.

(21) Appl. No.: 12/187,009

(22) Filed: Aug. 6, 2008

(65) Prior Publication Data

US 2010/0033401 A1 Feb. 11, 2010

(51) Int. Cl.
*H01Q 21/00* (2006.01)
*H01Q 13/00* (2006.01)

(52) U.S. Cl. ..... 343/893; 343/772; 343/797; 343/790; 343/900

(58) Field of Classification Search ..... None
See application file for complete search history.

(56) References Cited

U.S. PATENT DOCUMENTS

| | | | | |
|---|---|---|---|---|
| 4,297,707 | A * | 10/1981 | Brunner et al. | 343/725 |
| 4,635,068 | A | 1/1987 | Wheeler et al. | |
| 7,598,917 | B2 * | 10/2009 | Chen | 343/725 |
| 2005/0134511 | A1 | 6/2005 | Haunberger et al. | |
| 2005/0134516 | A1 | 6/2005 | Du | |
| 2007/0085743 | A1 | 4/2007 | Eberhardt et al. | |
| 2007/0115194 | A1 * | 5/2007 | Song et al. | 343/773 |
| 2007/0247382 | A1 | 10/2007 | Wan | |

FOREIGN PATENT DOCUMENTS

| | | | |
|---|---|---|---|
| EP | 1 033 782 | A2 | 9/2000 |
| GB | 2 327 813 | A | 2/1999 |

OTHER PUBLICATIONS

Extended European Search Report corresponding to European Patent Application No. 09166501.8, dated Dec. 1, 2009.

* cited by examiner

*Primary Examiner* — Trinh Dinh
(74) *Attorney, Agent, or Firm* — Husch Blackwell LLP

(57) ABSTRACT

A multi-band antenna is provided that operates in at least two non-harmonically related frequency bands. The antenna includes a low frequency antenna for a relatively low frequency band of the at least two non-harmonically related frequency bands extending on a proximal end from a ground plane along a predominant axis and electrically isolated from the ground plane and a cone-shaped relatively high frequency antenna for a relatively high frequency band of the at least two non-harmonically related frequency bands disposed on and electrically connected to the proximal end of the low frequency antenna with an apex of the high frequency antenna disposed adjacent the ground plane coincident with the proximal end of the low frequency antenna and a base extending away from the ground plane coaxial with the predominant axis. The multi-band antenna further includes a first tubular sleeve extending from the ground plane coaxial with the predominant axis, said tubular sleeve electrically isolated from the ground plane, the low frequency antenna and high frequency antenna and a second tubular sleeve lying coaxial with the predominant axis extending from a marginal edge of the base of the high frequency antenna away from the ground plane, said second tubular sleeve electrically isolated from the high frequency antenna and low frequency antenna.

18 Claims, 3 Drawing Sheets

MULTI-BAND CEILING ANTENNA

FIELD OF THE INVENTION

The field of the invention relates to radio frequency antenna and more particularly to antenna that operate in a number of different non-harmonically related frequencies.

BACKGROUND OF THE INVENTION

Digital wireless systems, such as wireless local area networks, or cellular devices, such as cellular telephones may exist in a number of different frequency bands and may each use a unique communication protocol. For example, cellular and GSM telephones may operate in the 750-960 MHz frequency band, PCS and UMTS may operate in a 1700-2170 MHz frequency band, and WIFI may operate in the 2.4-5.8 GHz bands.

However, cellular, PCS, UMTS, and WIFI are often used with different types of devices, each with a different functionality and data processing capability. Because of the different functionality, it is often necessary for service providers to provide simultaneous infrastructure access under each of the different protocols.

One complicating factor with providing simultaneous access is that access under the different protocols often occurs in a number of different environments. While the environment could also be out-of-doors, the environment could also involve use within a restaurant, theater or other user space. Such environments do not allow for the use of bulky antenna or antenna structure that detracts from the architecture of the space.

Another complicating factor is that cellular, PCS, UMTS, and WIFI often use frequency bands that are not harmonically related. As such, an antenna designed for one frequency band may not work with other bands.

One prior art solution to the problem of multiple frequency bands has been to combine a monopole antenna with a choke and a patch antenna to create a multi-band antenna structure. The patch may be conventional or include one or more slots for high frequency operation.

While, the use of the monopole and patch antenna is effective in some cases, the monopole antenna often experiences a phase reversal at high frequencies resulting in an elevation pattern split of a radiated signal. In addition where the patch antenna structure exceeds ¼ wavelength in high band frequencies, the radiated field has significant azimuth pattern distortion. Accordingly, a need exist for better antenna that operate in multiple non-harmonically related frequency bands.

SUMMARY

A multi-band antenna is provided that operates in at least two non-harmonically related frequency bands. The antenna includes a low frequency antenna for a relatively low frequency band of the at least two non-harmonically related frequency bands extending on a proximal end from a ground plane along a predominant axis and electrically isolated from the ground plane and a cone-shaped relatively high frequency antenna for a relatively high frequency band of the at least two non-harmonically related frequency bands disposed on and electrically connected to the proximal end of the low frequency antenna with an apex of the high frequency antenna disposed adjacent the ground plane coincident with the proximal end of the low frequency antenna and a base extending away from the ground plane coaxial with the predominant axis. The multi-band antenna further includes a first tubular sleeve extending from the ground plane coaxial with the predominant axis, said tubular sleeve electrically isolated from the ground plane, the low frequency antenna and high frequency antenna and a second tubular sleeve lying coaxial with the predominant axis extending from a marginal edge of the base of the high frequency antenna away from the ground plane, said second tubular sleeve electrically isolated from the high frequency antenna and low frequency antenna.

In another aspect, the cone-shaped high frequency antenna further includes a plurality of discrete antenna elements arranged in a circle around the low frequency antenna, where each of the plurality of antenna elements extend between the apex and base and where a corresponding location on each of the plurality of antenna elements is equidistant from the predominant axis.

In another aspect, the first tubular sleeve further includes a plurality of discrete antenna elements arranged in a circle around the low frequency antenna, where each of the plurality of antenna elements extend between the ground plane parallel to the predominant axis.

In another aspect, the second tubular sleeve further includes a plurality of discrete antenna elements arranged in a circle around the low frequency antenna, where each of the plurality of antenna elements extend between the base parallel to the predominant axis.

In another aspect, the multi-band antenna includes a pair of printed circuit boards interleaved orthogonally along the predominant axis with a pair of elements of each of the low frequency antenna, high frequency antenna, first tubular sleeve and second tubular sleeve disposed on each of the printed circuit boards.

In another aspect, the low frequency antenna further comprises a radiator element coaxial with the predominant axis and extending from a distal end of the low frequency antenna parallel with the ground plane.

In another aspect, the radiator element further comprises a dielectric disposed between the radiator element and low frequency antenna to electrically isolate the radiator element from the low frequency antenna.

DETAILED DESCRIPTION OF AN ILLUSTRATED EMBODIMENT

Figure 1:
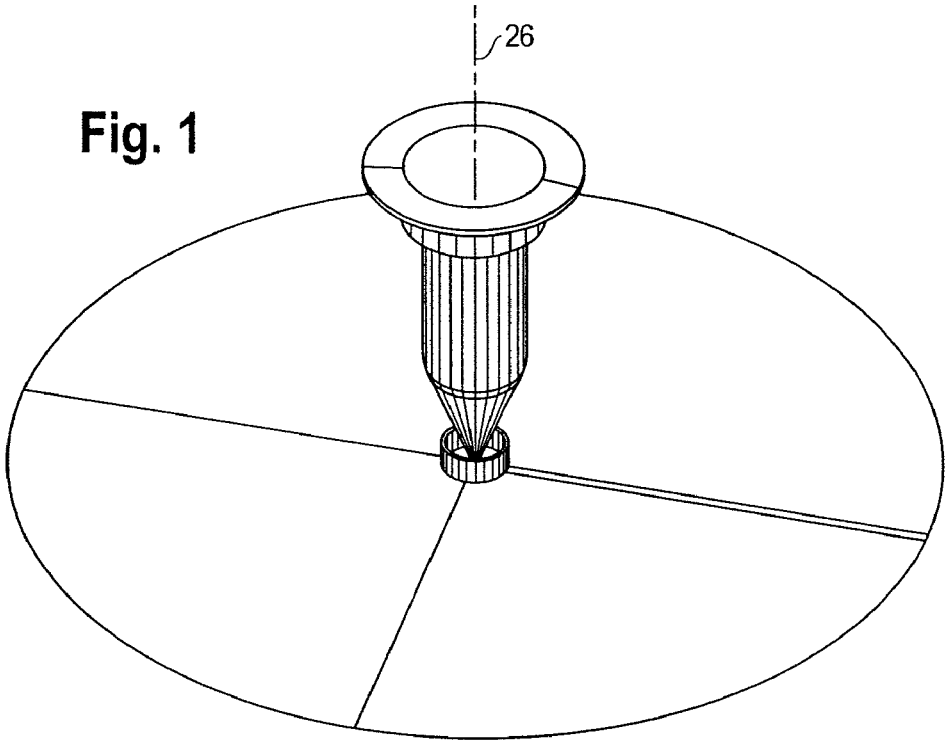
FIG. 1 is a multiband ceiling antenna in accordance with an illustrated embodiment of the invention.
Figure 2:
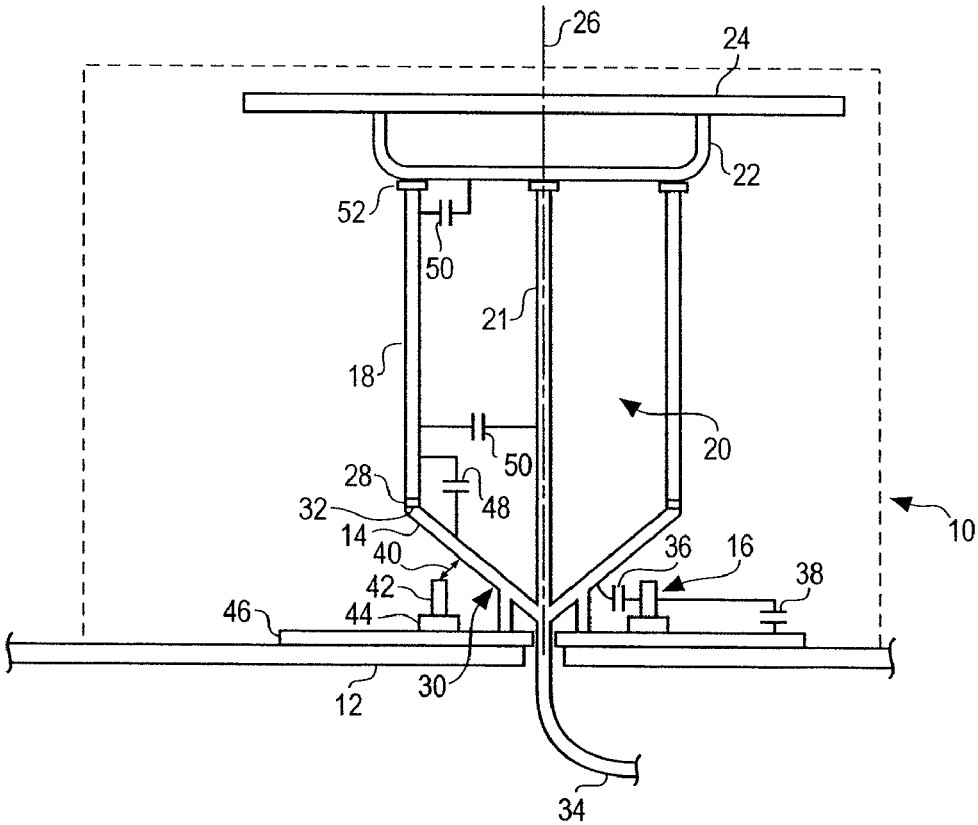
FIG. 2 is a cut-away view of the antenna of FIG. 1.

FIG. 1 depicts an ultra-wide band antenna 10 shown generally in accordance with an illustrated embodiment of the invention. FIG. 2 is a cut-away side view of the antenna 10 of FIG. 1.

The antenna 10 may be used in any of a number of non-harmonic frequency bands. Examples include any (or all) of the frequency bands selected from the group consisting of 750-900 MHz/PCS/UMTS/2.3-2.7 GHz WiFi-WiMAX/3.3-3.8 GHz WiMAX/4.9-6 GHz WiFI.

Under a first illustrated embodiment, the antenna 10 includes a first, low frequency antenna 20 with a primary radiating element 21 extending orthogonally from a ground plane 12 with a proximal end adjacent a ground plane 12 along a longitudinal axis 26 towards a distal end. The low frequency antenna 20 is electrically isolated from the ground plane 12 and operates in a low frequency band of a set of non-harmonically related frequency bands.

In order to reduce height, the low frequency antenna 20 may include one or more auxiliary low frequency radiating elements 22, 24 coupled to the distal end of the antenna 20. As shown, the low frequency radiating elements 22, 24 extend from the distal end parallel to the ground plane 12. The coupling of the auxiliary radiating elements 22, 24 may be via a directed electrical connection or capacitive coupling.

Formed on the proximal end of the low frequency antenna 20 is a high frequency cone-shaped antenna 14. The high frequency antenna 14 operates in a relatively high frequency band of the non-harmonically related frequency bands. The low frequency antenna 20 and high frequency antenna 14 are both electrically coupled to a common radio frequency (rf) source through a rf connection (e.g., coaxial cable) 34.

An apex 30 of the cone-shaped antenna 14 is coincident with and electrically connected to the proximal end of the low frequency antenna 20 at the point where the proximal end of the low frequency antenna 20 is directly adjacent and extends through the ground plane 12. A distal end of the cone-shaped antenna 14 opposite the apex 30 (i.e., the cone base 32) is coaxial with the longitudinal axis 26 of the low frequency antenna 20.

Disposed around the apex 30 is a first conductive sleeve 16 extending from adjacent the ground plane 12. The conductive sleeve 16 includes a sleeve element 42 and a sleeve base 44.

The conductive sleeve 16 is electrically isolated (in a direct current sense) from both the high frequency antenna 14 and the ground plane 12. However, the conductive sleeve 16 is capacitively coupled 36 to the high frequency antenna 14 and is also capacitively coupled 38 to the ground plane 12.

The capacitive coupling 36 is determined by a distance 40 between the sleeve element 42 and cone-shaped antenna 14 and the type of dielectric disposed between the sleeve element 42 and cone-shaped antenna 14. The capacitive coupling of the second capacitor 38 is determined by a size of the base element 44 and the thickness and type of dielectric 46 disposed between the base element 44 and ground 12.

Extending away from the base end 32 of the cone-shaped antenna 14 (and from the ground plane 12) is a second conductive sleeve 18. A proximal end of the sleeve 18 is adjacent a marginal edge of the cone base 32 and is electrically isolated from the base 32 by a dielectric spacer 28. A distal end of the sleeve 18 engages a proximal end of the auxiliary element 22 and is electrically isolated from the auxiliary element 22 by a dielectric spacer 52.

In one particular illustrated embodiment, the low frequency antenna 20 may have a total height of 82 mm including a primary radiating element 21 that is 69 mm high with a pair of secondary radiating elements 22, 24 that extend another 13 mm. The diameter of the radiating element 24 is 206 mm.

The high frequency cone 14 has a height of 26.5 mm along the longitudinal axis 26 and the diameter of the base 32 is 21 mm. The first conductive sleeve 16 has a height of 5.8 mm and a diameter of 15 mm. The dielectric 46 that supports the antenna 10 above the ground plane 12 is 6003 fiberglass with a 0.02 mm thick mylar tape on the upper surface.

The second conductive sleeve 18 has a diameter of 21 mm and a height parallel to the predominant axis 26 of 41 mm. The dielectric 28 that separates the high frequency antenna 14 and second conductive sleeve 18 is 1.5 mm thick.

Figure 3:
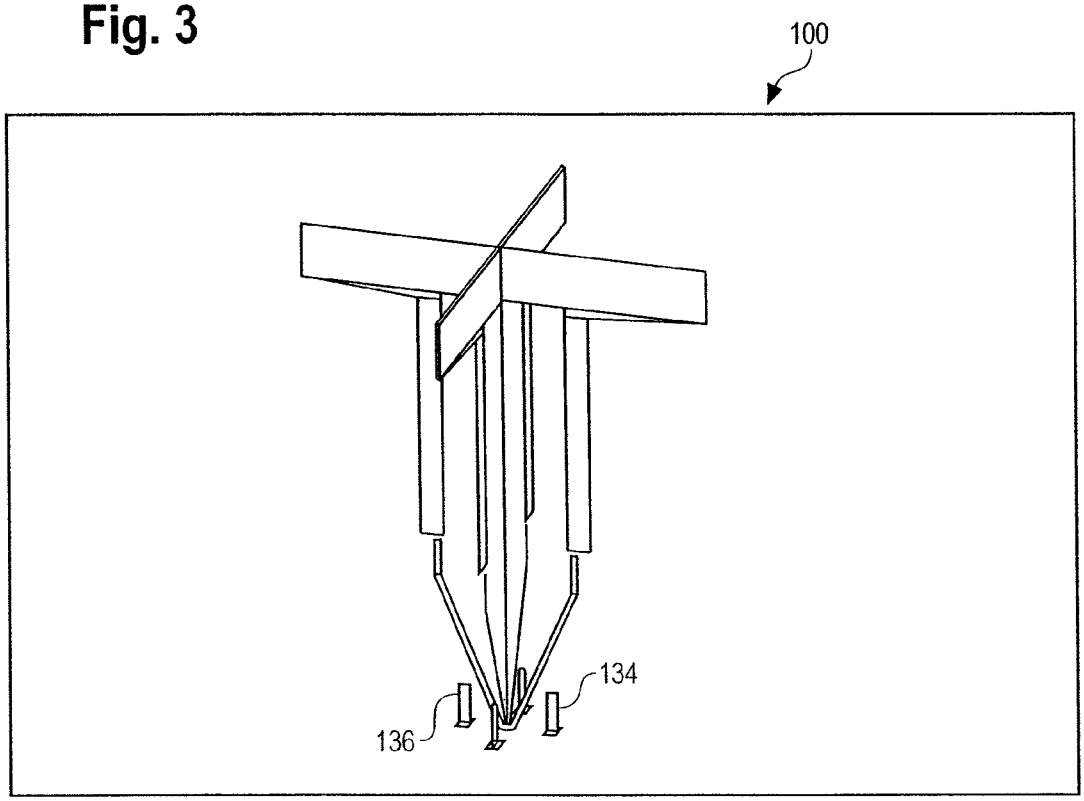
FIG. 3 is a side perspective view of an alternative embodiment of the antenna of FIG. 1.

In another embodiment, the elements 14, 16, 18, 20 of the antenna 10 may be divided into a number of discrete elements that are continuous in a direction extending away from the ground plane 12, but discrete in a circular direction around the predominant axis 26. FIG. 3 is a side perspective view of the antenna 10 (now labeled antenna 100 in FIG. 3) where the elements 14, 16, 18, 20 are divided into four discrete elements (e.g., copper traces) extending upwards from the ground plane 12.

Figure 4A:
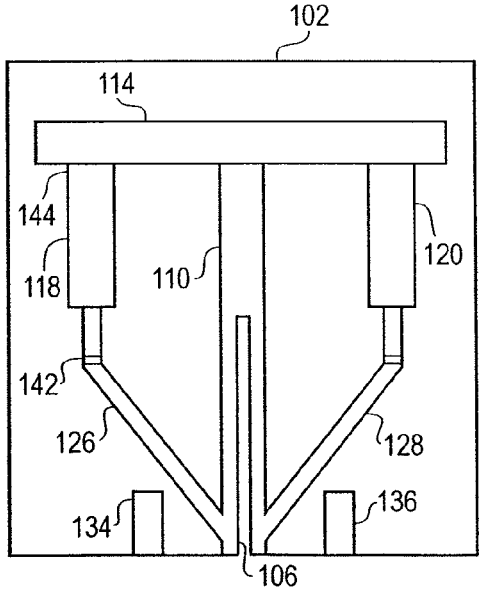
FIGS. 4*a-b* is side views of the circuit boards forming the antenna of FIG. 3.
Figure 4B:
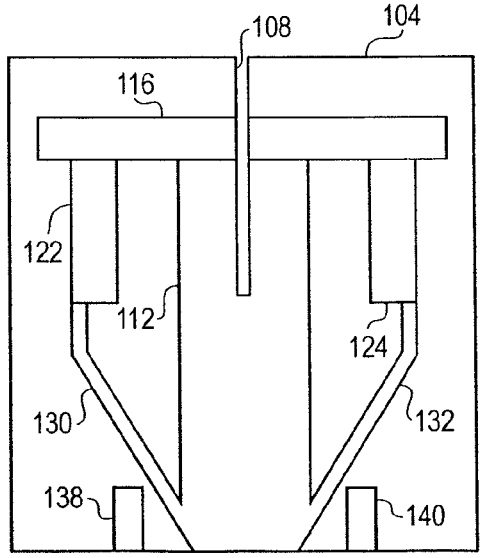

FIGS. 4*a-b* show side views of two circuit boards 102, 104 that may be used to construct the antenna 100 in conjunction with the circuit board 46. As shown in FIGS. 4*a-b*, the circuit boards 102, 104 each have a slot 106, 108 that allows the circuit boards 102, 104 to be interleaved at substantially right angles. Once the boards 102, 104 have been interleaved, the junction between the boards 102, 104 may be joined through use of a solder bridge that electrically joins the copper traces of the primary radiating elements 110 and 112 and the secondary radiating elements 114, 116.

As shown in FIGS. 4*a-b*, radiating elements 110 and 112 function as equivalents of the primary radiating element 21 shown in FIGS. 1 and 2 and radiating elements 114, 116 function as equivalents of the radiating elements 22, 24. Similarly, the cone shaped high frequency antenna 14 of FIGS. 1 and 2 has now been divided up into discrete radiating elements 126, 128, 130, 132.

The sleeves 16, 18 of FIGS. 1 and 2 have been similarly divided. For example, sleeve elements 118, 120, 122, 124 now serve substantially the same function as sleeve 18 of FIG. 1. Similarly, sleeve elements 134, 136, 138, 140 now serve substantially the same function as the sleeve 16 of FIG. 1. As with the sleeve elements 16, 18, a dialectric material 142, 144 separates the sleeve elements 134, 136, 138, 140 from the high frequency antenna 14 of FIG. 3.

Figure 5:
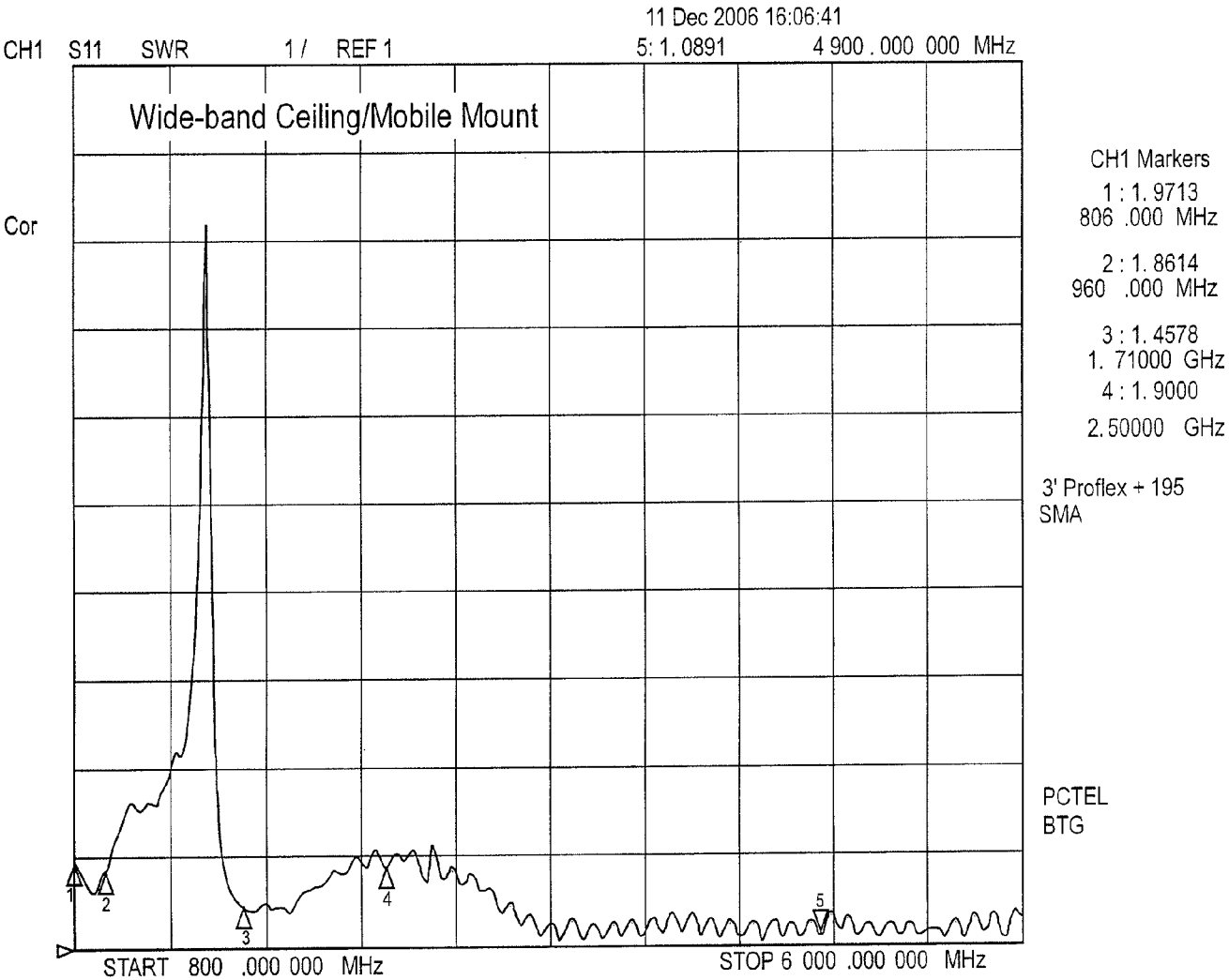
FIG. 5 is a VSWR graph of the antenna of FIGS. 1-4.

FIG. 5 provides a VSWR for the antenna 10, 100 over a relatively large set of frequency bands. As may be seen from FIG. 5, the antenna 10, 100 has a relatively low VSWR in the cellular bands as well as the higher frequency bands.

The antenna 10, 100 performs well over a broad range of non-harmonically related frequency bands. The high frequency cone-shaped antenna 14 operates as a sleeve monopole covering the high band. One difference is that the cone-shaped nature of the high band antenna 14 serves as a broadband choke for high band frequencies essentially preventing high frequency components from propagating upwards past the cone into the low frequency antenna 20.

The frequency characteristics of the high frequency cone-shaped antenna 14 may be determined by the size of the copper traces 42, 44 on the boards 46, 102, 104. For example, by increasing the size of the copper trace 42 (134, 136, 138, 140 in FIG. 4), the capacitive coupling 36 is increased thereby allowing the first sleeve 16 to become a radiator in certain frequency ranges. Similarly, increasing the size of the copper traces 44 increases the capacitive coupling 38 with the ground plane 12, thereby decreasing the radiation capabilities of the first sleeve 16.

The low frequency antenna 20 is the primary radiator in the lower bands. The first sleeve 18 around the low frequency antenna 20 curbs the mid-band frequencies (e.g., at about ¼ wavelength) and also acts as a low band radiator. The low band antenna 20 and choke 18 are not connected.

The top section (secondary radiators 22, 24) provide loading for proper operation in the low band. Larger secondary radiators 22, 24 would shift the frequency lower. If a LC choke (parallel resonant circuit) with resonate frequency equal to the low band (800 MHz) were to be added onto the top radiator 24 to isolate the low band, then an even lower band (400 MHz or lower) can be realized (e.g., a coil loaded ⅛ wavelength monopole). As another alternative, a UHF hula hoop could be used for an even lower profile combination.

A specific embodiment of a multiband ceiling antenna has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A multi-band antenna that operates in at least two non-harmonically related frequency bands, such antenna comprising:

a low frequency antenna for a relatively low frequency band of the at least two non-harmonically related frequency bands extending on a proximal end from a ground plane along a predominant axis and electrically isolated from the ground plane;

a cone-shaped relatively high frequency antenna for a relatively high frequency band of the at least two non-harmonically related frequency bands disposed on and electrically connected to the proximal end of the low frequency antenna with an apex of the high frequency antenna disposed adjacent the ground plane coincident with the proximal end of the low frequency antenna and a base extending away from the ground plane coaxial with the predominant axis;

a first tubular sleeve extending from the ground plane coaxial with the predominant axis, said tubular sleeve electrically isolated from the ground plane, the low frequency antenna and high frequency antenna; and a second tubular sleeve lying coaxial with the predominant axis extending from a marginal edge of the base of the high frequency antenna away from the ground plane, said second tubular sleeve electrically isolated from the high frequency antenna and low frequency antenna.

2. The multi-band antenna as in claim 1 wherein the cone-shaped high frequency antenna further comprises a plurality of discrete antenna elements arranged in a circle around the low frequency antenna, where each of the plurality of antenna elements extend between the apex and base and where a corresponding location on each of the plurality of antenna elements is equidistant from the predominant axis.

3. The multi-band antenna as in claim 2 wherein the first tubular sleeve further comprises a plurality of discrete antenna elements arranged in a circle around the low frequency antenna, where each of the plurality of antenna elements extend between the ground plane parallel to the predominant axis.

4. The multi-band antenna as in claim 3 wherein the second tubular sleeve further comprises a plurality of discrete antenna elements arranged in a circle around the low frequency antenna, where each of the plurality of antenna elements extend between the base parallel to the predominant axis.

5. The multi-band antenna as in claim 4 further comprising a pair of printed circuit boards interleaved orthogonally along the predominant axis with a pair of elements of each of the low frequency antenna, high frequency antenna, first tubular sleeve and second tubular sleeve disposed on each of the printed circuit boards.

6. The multi-band antenna as in claim 1 wherein the low frequency antenna further comprises a radiator element coaxial with the predominant axis and extending from a distal end of the low frequency antenna parallel with the ground plane.

7. The multi-band antenna as in claim 6 wherein the radiator element further comprises a dielectric disposed between the radiator element and low frequency antenna to electrically isolate the radiator element from the low frequency antenna.

8. The multi-band antenna as in claim 6 wherein the radiator element further comprises a dielectric disposed between the radiator element and second tubular sleeve to electrically isolate the radiator element from the low frequency antenna.

9. A multi-band antenna that operates in at least two non-harmonically related frequency bands, such antenna comprising:

a cone-shaped antenna element for a relatively high frequency band of the at least two non-harmonically related frequency bands, said cone-shaped antenna element extending from a ground plane with an apex end of said cone-shaped cone-shaped antenna element disposed adjacent the ground plane on a proximal end and a base of the cone-shaped antenna element extending away from the ground plane with a predominant axis of the cone-shaped antenna element extending from the apex through a center of the base, the cone-shaped antenna element electrically isolated from the ground plane;

a first plurality of electrically conductive secondary antenna elements extending from the ground plane parallel to the predominant axis of the cone-shaped antenna element and arranged in a circle with the plurality of secondary antenna elements each capacitively coupled to the cone-shaped antenna element and ground plane, said coupling causing the first plurality of secondary elements to electrically float between an electrical potential of the cone-shaped antenna element and ground plane;

an antenna extension operating on a lower relative frequency band than the high frequency band, the antenna extension electrically coupled to and extending away from the base and ground plane along the predominant axis; and a second plurality of electrically conductive secondary antenna elements extending away from the base parallel to the antenna extension and arranged in a circle around the antenna extension with the second plurality of secondary antenna elements each capacitively coupled to the antenna extension and first plurality of secondary elements, said coupling causing the second plurality of secondary elements to electrically float between an electrical potential of the first plurality of secondary elements and the electrical potential of the antenna extension and where the predominant axis is disposed in the center of both circles.

10. The multi-band antenna of claim 9 wherein the first plurality of secondary antenna elements further comprises a tubular sleeve.

11. The multi-band antenna of claim 9 wherein the second plurality of secondary antenna elements further comprises a tubular sleeve.

12. The multi-band antenna of claim 9 further comprises a cross-member extending from a distal end of the antenna extension parallel to the ground plane.

13. The multi-band antenna of claim 9 further comprises a pair of mutually orthogonal cross-members extending from a distal end of the antenna extension parallel to the ground plane.

14. The multi-band antenna of claim 9 wherein the first plurality of secondary antenna elements further comprises a length parallel to the predominant axis substantially equal to a quarter wavelength of the relative high frequency band.

15. The multi-band antenna of claim 9 wherein the second plurality of secondary antenna elements further comprises a length parallel to the predominant axis substantially equal to a quarter wavelength of the intermediate frequency band.

16. The multi-band antenna of claim 9 further comprising a dielectric disposed between the cone-shaped cone-shaped element and each of the second plurality of secondary elements.

17. A multi-band antenna that operates in at least two non-harmonically related frequency bands, such antenna comprising:

a cone-shaped antenna element for a relatively high frequency band of the at least two non-harmonically related frequency bands with an apex of the cone-shaped antenna element disposed proximate the ground plane, the cone-shaped antenna element extending along a predominant axis from the apex to a distal base end, the cone-shaped antenna element electrically isolated from the ground plane;

a first plurality of secondary antenna elements extending parallel to the predominant axis and arranged in a circle around the cone-shaped antenna element with each of the plurality of secondary antenna elements capacitively coupled to the cone-shaped antenna element and ground plane so as to electrically float between an electrical potential of the cone-shaped antenna element and ground plane;

an antenna extension operating at a relatively low frequency band below the high frequency band, the antenna extension electrically coupled to and extending away from the base end and ground plane along the predominant axis; and a second plurality of secondary antenna elements extending away from the base parallel to the antenna extension and arranged in a circle around the antenna extension and each capacitively coupled to the antenna extension and first plurality of secondary elements so as to electrically float between an electrical potential of the first plurality of secondary antenna elements and the antenna extension and where the predominant axis is disposed in the center of both circles.

18. A multi-band antenna that operates in at least two non-harmonically related frequency bands, such antenna comprising:

cone-shaped high frequency antenna element, the apex of the cone disposed adjacent a ground plane and a base on an opposing end extending away from the ground plane along a longitudinal axis of the cone;

a first conductive sleeve of discrete elements extending away from the ground plane parallel to the longitudinal axis that surrounds at least the apex of the cone-shaped antenna element and where the conductive sleeve is electrically isolated from the ground plane and high frequency antenna element;

an antenna extension that operates at an intermediate frequency band lower than the high frequency band, the antenna extension electrically coupled to and extending away from the base end and ground plane along the predominant axis; and a second conductive sleeve of discrete elements extending away from the base parallel to the antenna extension and arranged in a circle around the antenna extension and each capacitively coupled to electrically float between an electrical potential of the first sleeve and the antenna extension and where the predominant axis is disposed in the center of both circles.

* * * * *